US012127665B2

(12) United States Patent
McMillan et al.

(10) Patent No.: US 12,127,665 B2
(45) Date of Patent: Oct. 29, 2024

(54) CHILD HANDWASHING DEVICE

(71) Applicants: Laurie McMillan, Kimberling City, MO (US); Tanner McMillan, Kimberling City, MO (US)

(72) Inventors: Laurie McMillan, Kimberling City, MO (US); Tanner McMillan, Kimberling City, MO (US)

( * ) Notice: Subject to any disclaimer, the term of this patent is extended or adjusted under 35 U.S.C. 154(b) by 226 days.

(21) Appl. No.: 17/569,005

(22) Filed: Jan. 5, 2022

(65) Prior Publication Data

US 2023/0103469 A1 Apr. 6, 2023

Related U.S. Application Data

(60) Provisional application No. 63/252,082, filed on Oct. 4, 2021.

(51) Int. Cl.
*A46B 15/00* (2006.01)
*A47K 7/04* (2006.01)

(52) U.S. Cl.
CPC ..... *A46B 15/0008* (2013.01); *A46B 15/0022* (2013.01); *A46B 15/0046* (2013.01); *A47K 7/043* (2013.01); *A46B 2200/1006* (2013.01)

(58) Field of Classification Search
CPC ..... A47K 7/04; A47K 7/043; A46B 13/02; A46B 13/023; A46B 15/0008; A46B 15/0016; A46B 15/0022; A46B 15/0036; A46B 15/0038; A46B 15/0044; A46B 15/0046; A46B 2200/1006;
(Continued)

(56) References Cited

U.S. PATENT DOCUMENTS 5,388,825 A * 2/1995 Myers ..... A63B 43/06 473/570
5,779,574 A * 7/1998 Allman ..... A63B 43/06 473/570

(Continued)

OTHER PUBLICATIONS

Toysmith Store, Toysmith Virus Hand Wash Helper, High Bounce Light Up Ball, Wash Until It Stops Flashing, Retrieved from Amazon, Retrieved on Aug. 17, 2021 <URL: https://www.amazon.com/Toysmith-Virus-Helper-Bounce-Flashing/dp/B08VR7WN8W>.

(Continued)

*Primary Examiner* — Randall E Chin

(57) ABSTRACT

A handwashing device that provides an incentive for proper handwashing is presented. The handwashing device contains a housing, a brush layer, a processing unit, an activation element, an indicator element, and a timer switch. The housing is positioned within the brush layer. The processing unit is positioned within the housing. The processing unit, the activation element, the indicator element, and the timer switch are electronically connected to the processing unit. In the preferred embodiment, the housing may take the form of a rigid and waterproof electronics enclosure that houses the electronic components that constitutes the handwashing device. Additionally, the housing serves as a mounting implement for the brush layer to attach along where the brush layer conforms to the shape of the housing. In the preferred embodiment, the housing is constructed out of a light permeable material, such as, but not limited to translucent polycarbonate, or any other suitable material.

10 Claims, 6 Drawing Sheets

(58) Field of Classification Search
CPC ..... A46B 2200/1013; A63B 43/06; A63H 33/18; A63H 33/22; F21V 33/00; F21V 33/0004; F21V 33/008; F21V 33/0084; F21V 33/004
USPC ..... 15/167.3, 229.11, 229.12, 229.13
See application file for complete search history.

(56) References Cited

U.S. PATENT DOCUMENTS

| | | | | |
|---|---|---|---|---|
| 6,428,432 | B1 * | 8/2002 | Kachel | A63B 43/06 473/570 |
| 7,131,987 | B2 | 11/2006 | Sherman | |
| D561,277 | S * | 2/2008 | Chernick | D21/707 |
| 9,521,899 | B1 * | 12/2016 | Tai | A46B 5/02 |
| D833,542 | S * | 11/2018 | Reynolds | D21/493 |
| 10,213,064 | B2 | 2/2019 | Sedic | |
| 2002/0112741 | A1 | 8/2002 | Pieroni | |
| 2004/0141321 | A1 * | 7/2004 | Dowling | A63H 33/22 362/276 |
| 2006/0146525 | A1 * | 7/2006 | Chernick | B44C 5/005 362/196 |
| 2011/0038660 | A1 * | 2/2011 | Rudolph | A46B 13/008 401/138 |
| 2020/0360221 | A1 * | 11/2020 | Tseng | A61H 23/0254 |

OTHER PUBLICATIONS

Learning Resources Store, Learning Resources 20-Second Handwashing Timer, Retrieved from Amazon, Retrieved on Aug. 17, 2021 <URL: https://www.amazon.com/Learning-Resources-20-Second-Handwashing-Timer/dp/B08DJS9644>.

* cited by examiner

CHILD HANDWASHING DEVICE

FIELD OF THE INVENTION

The present invention relates generally to a handwashing device. More specifically, the present invention is an illuminated multi-bristled handwashing device that provides proper handwashing technique and practices to a child or any other user.

BACKGROUND OF THE INVENTION

While there are a multitude of joys that come with being a parent, there are also a variety of frustrations and difficulties that arise when becoming a guardian of children. Difficulty is often faced by parents when attempting to instill discipline for hygienic routines in children. Hygiene, while obviously important to adults, is hardly considered necessary in the minds of children. Because of this, children rarely have a desire to take part in activities such as bathing or brushing teeth and typically fight against being told to do so. A common routine often skipped by children is washing hands at times such as after using a bathroom or before a meal. It is important for children's hands to be clean as children's immune systems are still developing and are typically at higher risk of illness than the immune systems of adults. Children also tend to rinse their hands under the water for a few seconds and assume those few seconds under the water are enough to remove bacteria. It is recommended that individuals wash their hands with soap and warm water for at least twenty seconds. Parents utilize many methods to get children to engage in important routines such as the ones mentioned. Methods that include some kind of incentive or fun are typically the most effective, as children usually respond well to fun activities.

An objective of the present invention is to provide an incentive for a child to wash the child's hands for the recommended length of time. The present invention includes a design that children enjoy playing with and an internal lighting mechanism that runs for the recommended twenty seconds that one should spend washing one's hands.

SUMMARY OF THE INVENTION

The present invention is a handwashing device that provides an incentive for proper handwashing. The handwashing device comprises a housing, a brush layer, a processing unit, an activation element, an indicator element, and a timer switch. The housing is positioned within the brush layer. The processing unit is positioned within the housing. The processing unit, the activation element, the indicator element, and the timer switch are electronically connected to the processing unit. In the preferred embodiment, the housing may take the form of a rigid and waterproof electronics enclosure that houses the electronic components that constitutes the handwashing device. Additionally, the housing serves as a mounting implement for the brush layer to attach along where the brush layer conforms to the shape of the housing. In the preferred embodiment, the housing is constructed out of a light permeable material, such as, but not limited to translucent polycarbonate, or any other suitable material.

DETAIL DESCRIPTIONS OF THE INVENTION

Figure 1:
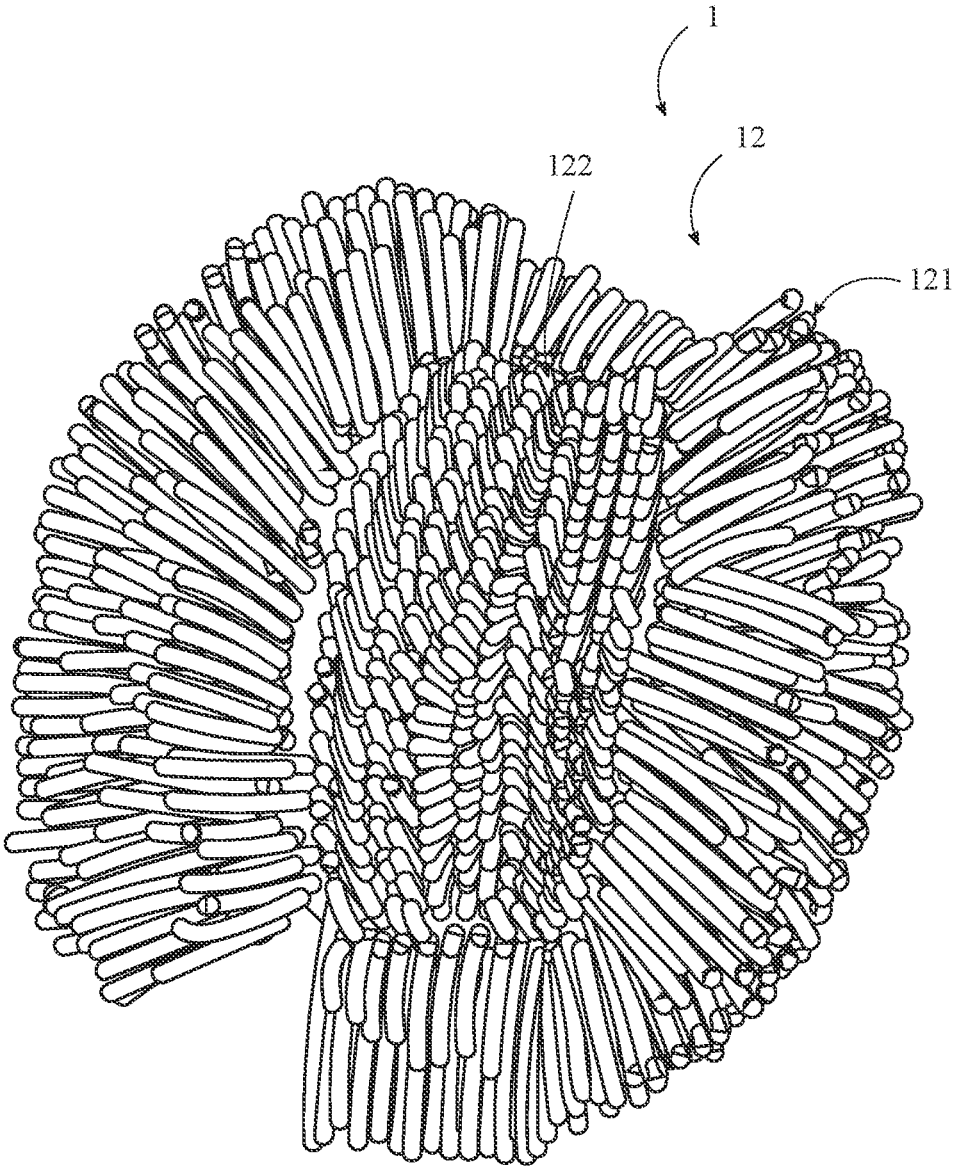
FIG. 1 is a top perspective view of the present invention.
Figure 2:
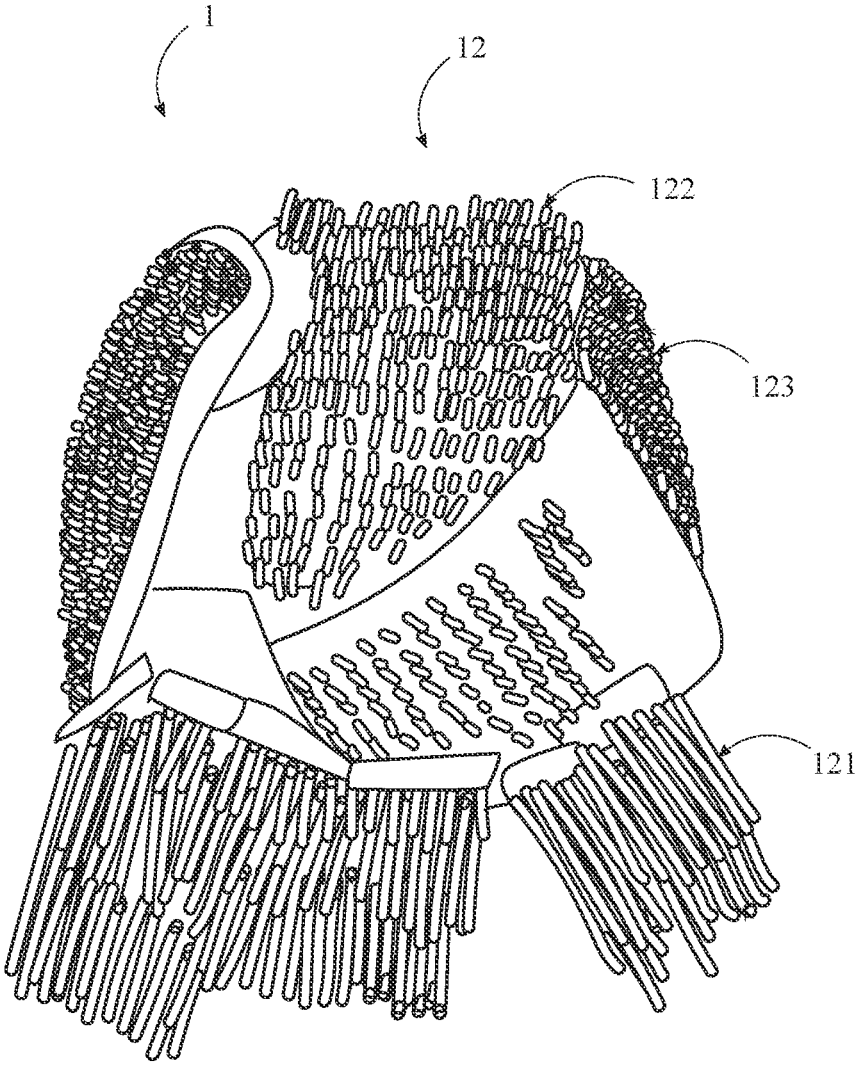
FIG. 2 is a bottom perspective view of the present invention.
Figure 3:
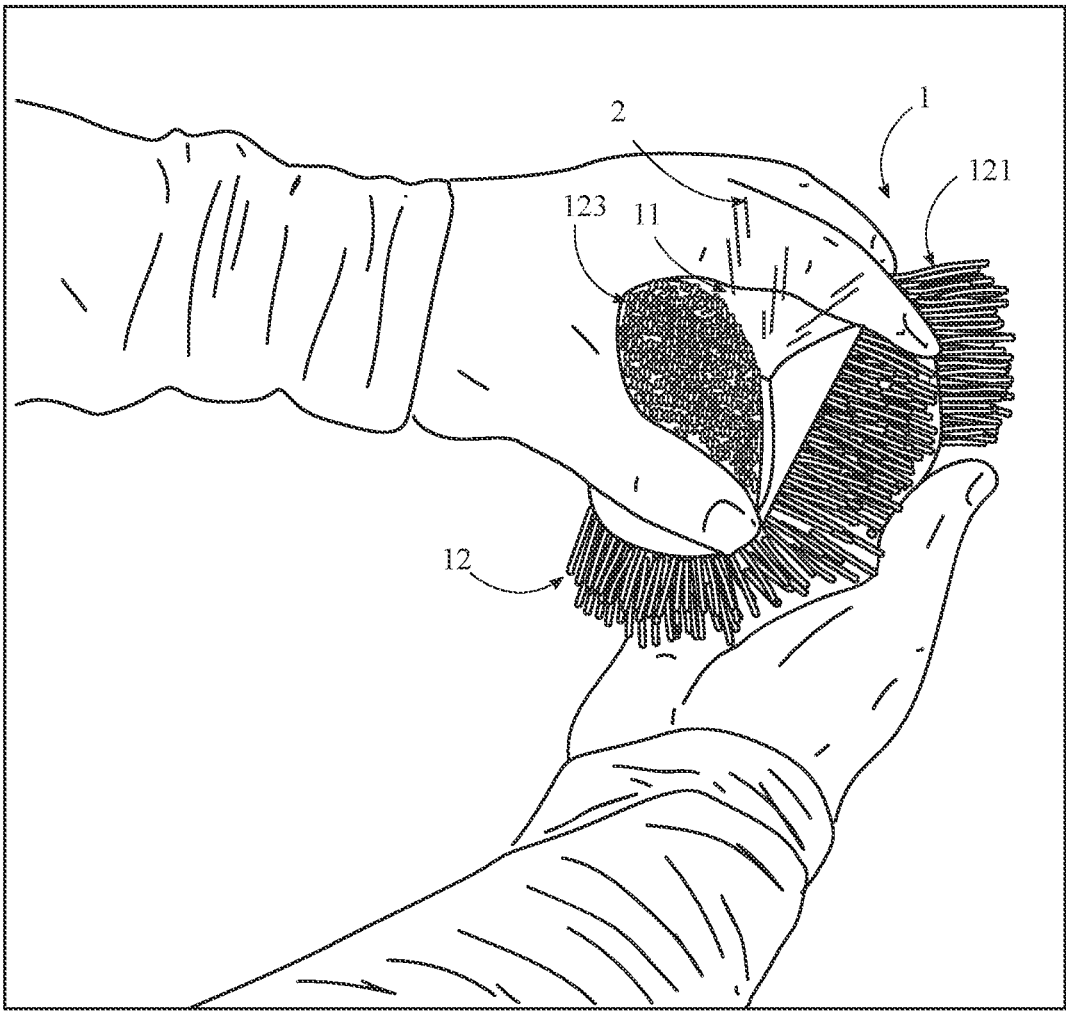
FIG. 3 is an illustration of the present invention that shows a user scrubbing between their fingers and hands along a brush layer.
Figure 4:
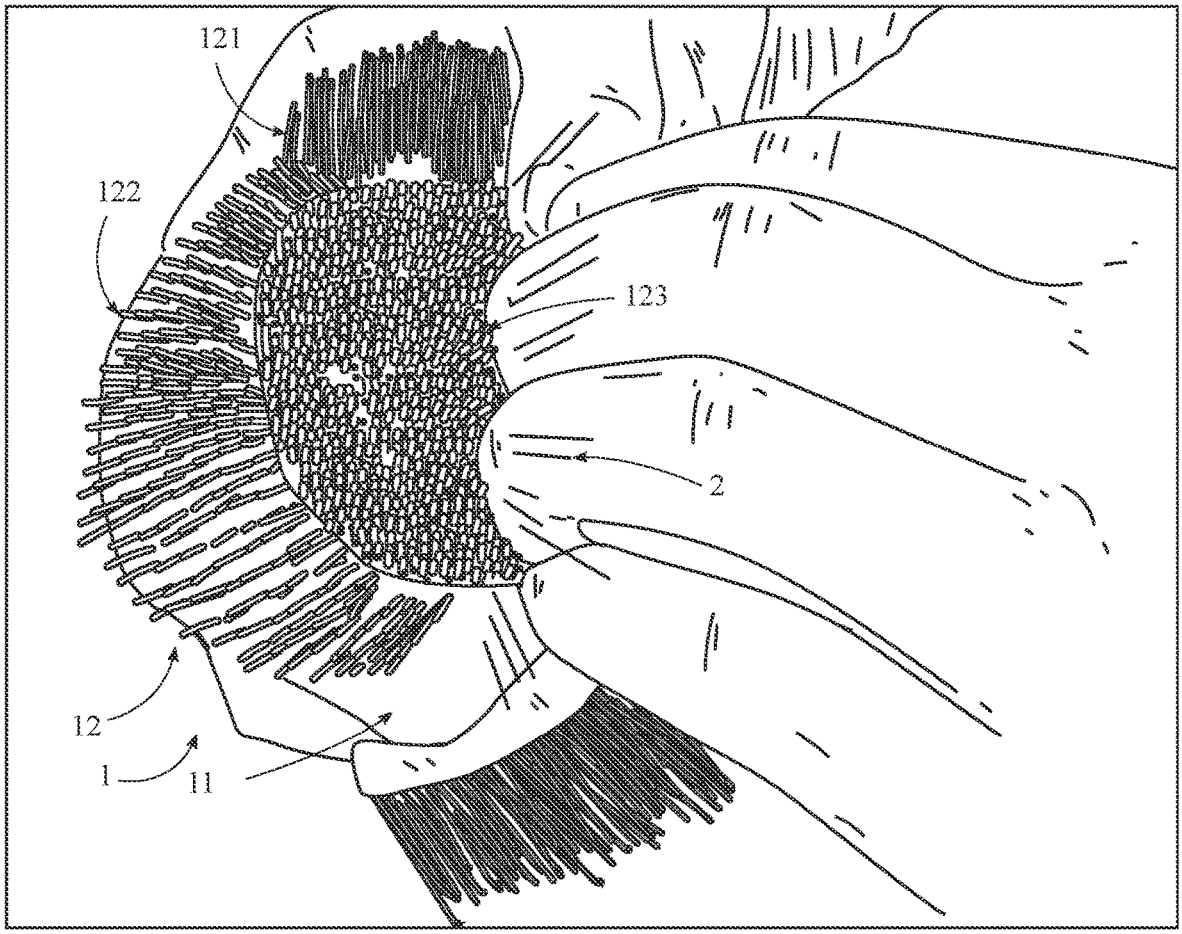
FIG. 4 is an illustration of the present invention that shows a user scrubbing their knuckles and fingernails along the brush layer.
Figure 5:
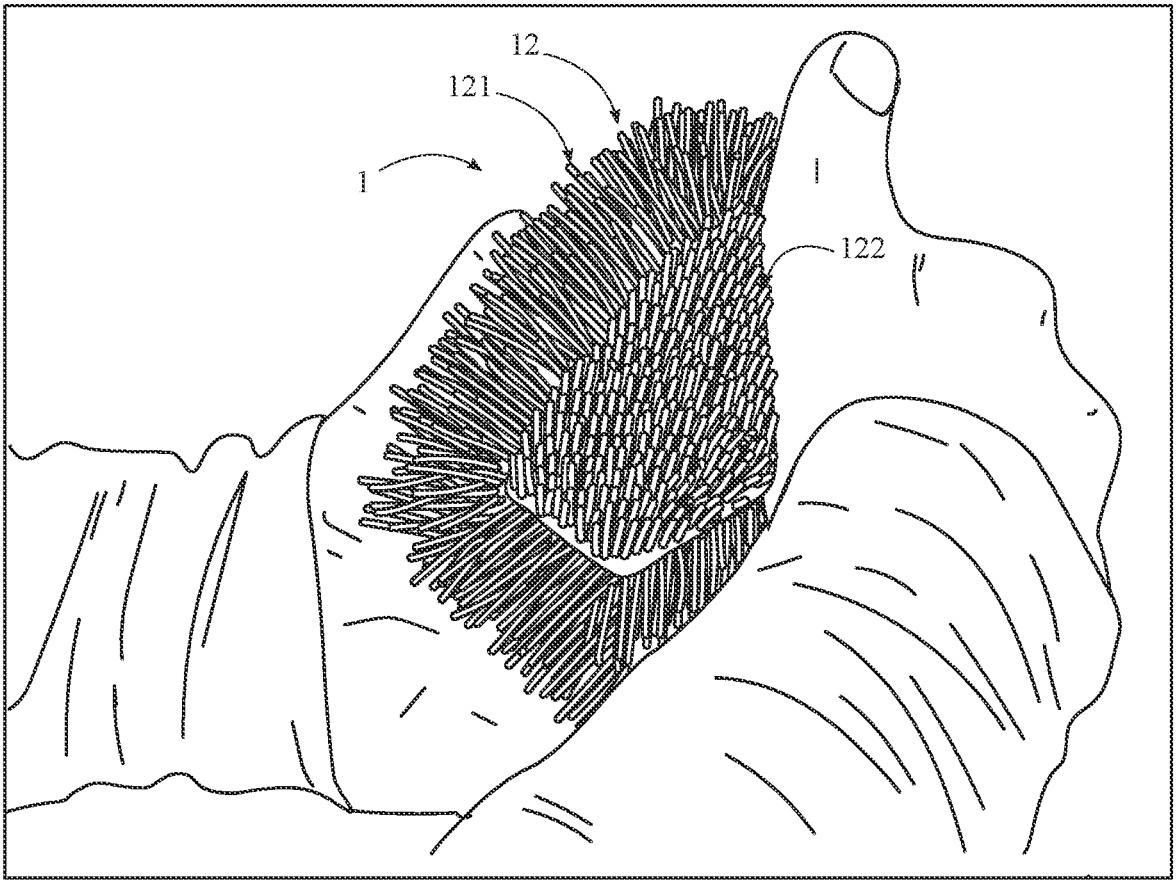
FIG. 5 is an illustration of the present invention that shows a user scrubbing their palm along the brush layer.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-5, the present invention is a handwashing device 1 that provides an incentive for proper handwashing. More specifically, the handwashing device 1 provides a means for a user to properly wash their hands in a specified timeframe. In the preferred embodiment, children are the targeted users of the present invention such that the present invention provides a fun, exciting, and easy way to wash their hands properly. In reference to FIGS. 1-6, the handwashing device 1 comprises a housing 11, a brush layer 12, a processing unit 13, an activation element 14, an indicator element 15, and a timer switch 16. The housing 11 is positioned within the brush layer 12. The processing unit 13 is positioned within the housing 11. The processing unit 13 is connected to the activation element 14, the indicator element 15, and the timer switch 16 for electronic communication. In the preferred embodiment, the housing 11 may take the form of a rigid and waterproof electronics enclosure that houses the electronic components that constitutes the handwashing device 1. Additionally, the housing 11 serves as a mounting implement for the brush layer 12 to attach along where the brush layer 12 conforms to the shape of the housing 11. In the preferred embodiment, the housing 11 is constructed out of a light permeable material, such as, but not limited to translucent polycarbonate, or any other suitable material.

In the preferred embodiment, the housing 11 is spherical in shape but may take the form of any other suitable shape. In the preferred embodiment, the brush layer 12 serves as the primary handwashing layer of the handwashing device 1 that allows the user to scrub their hands along the brush layer 12 to clean their hands, as shown in FIGS. 1-5. In the preferred embodiment, the brush layer 12 is constructed out of a silicone material but can be made out of any other suitable material. In the preferred embodiment, the brush layer 12 is permanently fixed along the housing 11. In another embodiment, the brush layer 12 is removably attached along the housing 11 to accommodate a re-usable handwashing device 1. In the preferred embodiment, the processing unit 13 takes the form of a pre-programmed electronic computer unit that controls the electronic components that constitutes the handwashing device 1. More specifically, the processing unit 13 executes a handwashing time sequence that works in conjunction with the activation element 14, the indicator element 15, and the timer switch 16. First, the activation element 14 takes the form of any suitable activation switch that initiates the handwashing time sequence. Upon initiation of the handwashing time sequence through the activation element 14, the indicator element 15 is activated through the processing device where the indicator element 15 is configured to signal the user that the handwashing time sequence is still in effect through a specified indicator emission 2. In various embodiments, the indicator emission 2 may take the form of any suitable indicator emission 2 such as but not limited to illumination, vibratory, audio, or any other suitable indicator emission 2 that notifies the user that the handwashing time sequence is still in effect. The handwashing time sequence is concluded upon a specified timing threshold where the timer switch 16 deactivates the indicator element 15 and resets the handwashing time sequence.

Figure 6:
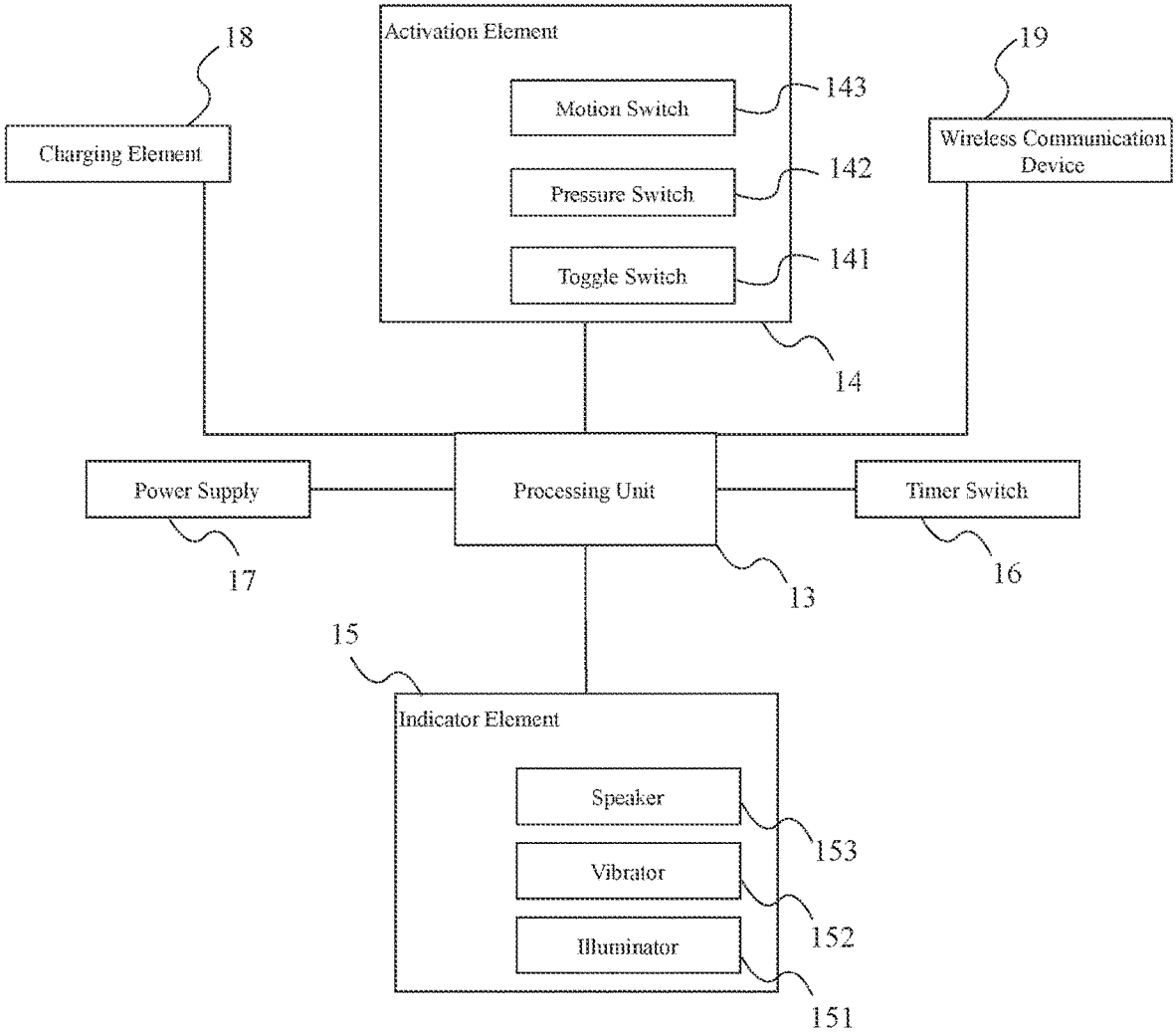
FIG. 6 is a circuit diagram used in the present invention.

In the preferred embodiment, the handwashing device 1 further comprises a power supply 17, as shown in FIG. 6. The power supply 17 is electronically connected to the processing unit 13 where the power supply 17 is configured to supply electrical power to the electronic components the constitutes the handwashing device 1. In the preferred embodiment, the power supply 17 may take the form of an integrated non-rechargeable battery with a specified life expectancy such that the specified life expectancy dictates the life expectancy of the handwashing device 1 where the handwashing device 1 is then disposed upon the exhaustion of the specified life expectancy of the non-rechargeable battery. In another embodiment, a re-chargeable battery is implemented to serve as the re-usable handwashing device 1.

In reference to FIGS. 1-5, the brush layer 12 comprises a first bristle portion 121, a second bristle portion 122, and a third bristle portion 123. The first bristle portion 121, the second bristle portion 122, and the third bristle portion 123 are distributed about the housing 11 through a specified pattern. The specified pattern may take the form of any suitable and optimal pattern that distributes the first bristle portion 121, the second bristle portion 122, and the third bristle portion 123 along the housing 11. In the preferred embodiment, the specified pattern may arrange the first bristle portion 121, the second bristle portion 122, and the third bristle portion 123 evenly along the housing 11. In the preferred embodiment, the first bristle portion 121 is constructed out of long bristles suitable for cleaning between the user's fingers. In the preferred embodiment. the second bristle portion 122 is constructed out of nail cleaning bristles suitable for cleaning the user's fingernails and knuckles. In the preferred embodiment, the third bristle portion 123 is constructed out of exfoliation bristles suitable for cleaning the palm and backside of the user's hands.

In reference to FIG. 6, the activation element 14 comprises a motion switch 143. The motion switch 143 is electronically connected to the processing unit 13. The motion switch 143 activates the handwashing time sequence when the user picks up and handles the handwashing device 1. In another embodiment, the activation element 14 comprises a toggle switch 141. The toggle switch 141 is electronically connected to the processing unit 13, where the toggle switch 141 serves as a manual activation of the handwashing time sequence. In this embodiment, the toggle switch 141 may take the form of a push button momentary switch that is accessible along the housing 11. In another embodiment, the activation element 14 comprises a pressure switch 142. The pressure switch 142 is electronically connected to the processing unit 13, where the pressure switch 142 allows the user to squeeze the handwashing device 1 to activate the handwashing time sequence.

In another embodiment, the handwashing device 1 further comprises a power supply 17 and a charging element 18. The power supply 17 and the charging element 18 are electronically connected to the processing unit 13. In this embodiment, the power supply 17 takes the form of a rechargeable battery. The charging element 18 takes the form of a waterproof charging implement, where the charging element 18 is configured to charge the power supply 17 through a corresponding charger device. The charger device may take the form of any suitable indirect charge device such as, but not limited to wireless dock chargers utilizing inductive recharging implements or any other suitable charge device.

In another embodiment, the handwashing device 1 further comprises a wireless communication device 19. The wireless communication device 19 is electronically connected to the processing unit 13. In this embodiment, the wireless communication device 19 takes the form of a wireless trans-receiver, where the wireless communication device 19 is configured to communicate with a smart device such as, but not limited to portable mobile devices or any other suitable smart devices. In this embodiment, the wireless communication device 19 facilitates connection with the smart device such that the handwashing device 1 is communicably coupled with a software application downloaded in the smart device.

Although the invention has been explained in relation to its preferred embodiment, it is to be understood that many other possible modifications and variations can be made without departing from the spirit and scope of the invention as hereinafter claimed.

What is claimed is:

1. A handwashing device comprising:

a housing;

a brush layer, comprising a first bristle portion, a second bristle portion, and a third bristle portion, wherein the first bristle portion comprising bristles longer than the second and third bristle portions, the second bristle portion comprising bristles longer than the third bristle portion, the third bristle portion comprising two segments situated along the sides of the device, the second bristle portion being generally positioned between the two segments of the third bristle portion, and the first bristle portion being generally positioned to envelope space between one or more edges of the second and third bristle portions;

a processing unit;

an activation element;

an indicator element wherein said indicator element comprises an illuminator;

a timer switch;

the housing being positioned within the brush layer;

the processing unit being positioned within the housing; and the processing unit being electronically connected to the activation element, the indicator element, and the timer switch.

2. The handwashing device as claimed in claim 1, wherein the brush layer is constructed out of a silicone material.

3. The handwashing device as claimed in claim 1, wherein the housing is constructed out of a light permeable material.

4. The handwashing device as claimed in claim 1, wherein the second bristle portion comprises nail cleaning bristles.

5. The handwashing device as claimed in claim 1, wherein the third bristle portion comprises bristles formed from an exfoliating material and a rough surface texture to promote exfoliation.

6. The handwashing device as claimed in claim 1, wherein the housing is spherical in shape.

7. The handwashing device as claimed in claim 1 comprising:

the activation element comprising a toggle switch; and the toggle switch being electronically connected to the processing unit.

8. The handwashing device as claimed in claim 1 wherein:

the illuminator is electronically connected to the processing unit.

9. The handwashing device as claimed in claim 1 comprising:

a power supply;

a charging element; and the power supply and the charging element being electronically connected to the processing unit.

10. The handwashing device as claimed in claim 1 comprising:

a wireless communication device; and the wireless communication device being electronically connected to the processing unit.

* * * * *